US009329515B2

(12) United States Patent
Ishikawa et al.

(10) Patent No.: US 9,329,515 B2
(45) Date of Patent: May 3, 2016

(54) RESIN-COATED CARRIER FOR ELECTROPHOTOGRAPHIC DEVELOPER AND ELECTROPHOTOGRAPHIC DEVELOPER USING THE RESIN-COATED CARRIER

(71) Applicant: POWDERTECH CO., LTD., Chiba (JP)

(72) Inventors: Makoto Ishikawa, Chiba (JP); Tetsuya Uemura, Chiba (JP); Masashi Aoki, Chiba (JP)

(73) Assignee: POWDERTECH CO., LTD., Chiba (JP)

( * ) Notice: Subject to any disclaimer, the term of this patent is extended or adjusted under 35 U.S.C. 154(b) by 0 days.

(21) Appl. No.: 14/227,564

(22) Filed: Mar. 27, 2014

(65) Prior Publication Data

US 2014/0295342 A1 Oct. 2, 2014

(30) Foreign Application Priority Data

Mar. 29, 2013 (JP) ..... 2013-074600
Dec. 27, 2013 (JP) ..... 2013-273013

(51) Int. Cl.
*G03G 9/00* (2006.01)
*G03G 9/113* (2006.01)
*G03G 9/107* (2006.01)

(52) U.S. Cl.
CPC ..... *G03G 9/1132* (2013.01); *G03G 9/1075* (2013.01); *G03G 9/1133* (2013.01); *G03G 9/1134* (2013.01); *G03G 9/1135* (2013.01); *G03G 9/1136* (2013.01)

(58) Field of Classification Search
CPC .. G03G 9/1132; G03G 9/1133; G03G 9/1135
USPC ..... 430/111.35
See application file for complete search history.

(56) References Cited

U.S. PATENT DOCUMENTS

2012/0032204 A1 2/2012 Zhang et al.

FOREIGN PATENT DOCUMENTS

| | | |
|---|---|---|
| EP | 1 260 874 | 11/2002 |
| EP | 1 553 460 | 7/2005 |
| JP | 06-324523 | 11/1994 |
| JP | 2008-40271 | 2/2008 |
| JP | 2008-077002 | 4/2008 |
| JP | 2008-089925 | 4/2008 |

OTHER PUBLICATIONS

Extended European Search Report of EP Patent Application No. 14162366.0, which was mailed Jul. 8, 2014.

*Primary Examiner* — Mark A Chapman
(74) *Attorney, Agent, or Firm* — Greenblum and Bernstein, P.L.C.

(57) ABSTRACT

Provided is a resin-coated carrier for an electrophotographic developer, wherein the surface of a magnetic particle is coated with a mixed resin composed of two resins, and when the two resins are denoted by the resin 1 and the resin 2, respectively, the relative difference between the respective adsorbed moisture amounts of the resin 1 and the resin 2 at a temperature of 30° C. and a relative humidity of 80% satisfies the following formula (1):

$$1 \leq |ax - b(100 - x)| \leq 10 \quad (1)$$

a: the adsorbed moisture content (% by weight) of the resin 1 b: the adsorbed moisture content (% by weight) of the resin 2 x: the content percentage of the resin 1 (0<x<100).

9 Claims, No Drawings

RESIN-COATED CARRIER FOR ELECTROPHOTOGRAPHIC DEVELOPER AND ELECTROPHOTOGRAPHIC DEVELOPER USING THE RESIN-COATED CARRIER

BACKGROUND OF THE INVENTION

1. Field of the Invention

The present invention relates to a resin-coated carrier for an electrophotographic developer used in a two-component electrophotographic developer used in copiers, printers and the like, and an electrophotographic developer using the resin-coated carrier.

2. Description of the Related Art

A two-component electrophotographic developer used in electrophotography is composed of a toner and a carrier, and the carrier serves as a carrying substance to form a toner image on a photoreceptor in such a way that the carrier is stirred and mixed together with the toner in a developing device, to impart an intended charge to the toner, and conveys the thus charged toner to an electrostatic latent image on a photoreceptor to form the toner image on the photoreceptor. And the developer is repeatedly used while the developer is being replenished with an amount of fresh toner corresponding to the amount of the toner spent by the development.

Accordingly, the carrier is required to be able to stably impart charge to the toner in a long term independently of the environmental variation.

However, in a high-temperature and high-humidity environment, the charge amount is decreased, and hence problems such as toner scattering and fogging are caused, and additionally the charge is leaked, and hence, for example, there occurs a problem such that the electrostatic latent image is destroyed, and a problem such that the resistance of the developer is decreased to cause carrier beads carry over.

On the other hand, at a low temperature and a low humidity, the charge amount is increased, and hence the image density is decreased, and when the charge amount is extremely increased, at the time of the transfer of the toner to the photoreceptor, the carrier is also pulled to cause carrier beads carry over. The resistance of the developer is also increased, and hence the effective bias is decreased, to offer a cause for the occurrence of image density decrease and fogging.

Several proposals have hitherto been made for the purpose of making satisfactory such an environment dependence of the charge amount as described above.

Japanese Patent Laid-Open No. 06-324523 describes a carrier for an electrostatic image developer in which a coating resin is made of a polymer containing an alkyl methacrylate in a proportion of 50% by weight or more, and the carrier coating layer is made of resin fine particles having a water content of 0.10 to 1.0% by weight in a high-temperature and high-humidity, and which is used in combination with a negatively charged toner formed by a dry coating method. It is stated that according to the carrier for the electrostatic image developer, even when the carrier is used in a high-temperature and high-humidity environment, the degradation of the image quality is not caused, and an image stable and high in quality can be output.

Japanese Patent Laid-Open No. 2008-077002 also describes a carrier for electrostatic image development in which a coating resin layer is formed on the surface of magnetic substance particles, the coating resin layer includes a resin having a cycloalkyl group (preferably, a resin polymerized with 95 mol % or more of a monomer having a cycloalkyl group), and when the carrier is allowed to stand in an environment of 32° C./85% RH for 48 hours, the moisture content of the carrier is 0.05% by mass or less. It is stated that according to the carrier for an electrostatic image development, the leakage of the charge is effectively prevented, and a satisfactory charging property, in particular, a satisfactory charge rise property can be obtained.

However, when the carriers described in Japanese Patent Laid-Open Nos. 06-324523 and 2008-077002 are used, there occurs a problem such that the charge up at a low temperature and a low humidity comes to be large and the decrease of the image density and the fogging tend to occur.

Japanese Patent Laid-Open No. 2008-089925 discloses a carrier for electrophotographic development in which the surface of the particles of a carrier core material is coated with a resin, and the coating include conductive fine particles having a pH of 7 or more. It is stated that according to the carrier for electrophotographic development, it is possible to obtain a carrier coping with both of the environment dependence at a low temperature and a low humidity and the environment dependence at a high temperature and a high humidity.

Japanese Patent Laid-Open No. 2008-089925 states that the use of a conductive fine particle having a pH of 7 or less allows the aggregation of the carrier to be made to hardly occur; however, some degree of aggregation cannot be avoided, and a state of the conductive fine particle being exposed from the coating resin layer can be easily anticipated to occur.

Accordingly, even when the carrier of Japanese Patent Laid-Open No. 2008-089925 is used, as the coating resin layer is abraded, the degree of exposure of the conductive fine particle is increased so as to increase the charge leakage at a high temperature and a high humidity, and hence the carrier of Japanese Patent Laid-Open No. 2008-089925 cannot be said to be sufficient with respect to the environment dependence.

In Japanese Patent Laid-Open Nos. 06-324523, 2008-077002 and 2008-089925, no countermeasures are taken for the durability, it is difficult to maintain the initial environment dependence, and moreover, the abrasion or the exfoliation of the coating resin layer proceeds to a large extent and hence there is also a possibility that the original charge imparting property is lost.

When as has been done in Japanese Patent Laid-Open No. 2008-089925, additives such as a conductive particle are added, a problem such as the strength decrease of the coating resin or the detachment of the conductive particle occurs, thus the durability cannot be said to be sufficient, and as a result, it tends to be difficult to obtain stable images in a long term use of the carrier.

SUMMARY OF THE INVENTION

Accordingly, an object of the present invention is to provide a resin-coated carrier for an electrophotographic developer, being excellent in the environment dependence of the charge amount from a low temperature and a low humidity to a high temperature and a high humidity, hardly undergoing exfoliation or abrasion of the coating resin even when being used for a long term as a developer together with a toner, being capable of maintaining the initial environment dependence and hence being capable of providing stable image quality over a long term, and to provide an electrophotographic developer using the resin-coated carrier for an electrophotographic developer.

For the purpose of solving such problems as described above to achieve the compatibility between the durability and the environment dependence, the present inventors made a diligent study, and consequently have found that the moisture adsorption having hitherto been considered to affect the environment dependence also affects the durability. The present inventors have also found that as a method for further increasing the durability, it is important that the adsorbed moisture amounts of the resins used are different from each other.

The present inventors have besides found that when the carrier core material is coated with resins, the adsorbed moisture amount difference helps the formation of the coating resin layer uniform and high in adhesion and additionally, when the carrier and the toner are mixed and used as a developer, the adsorbed moisture amount difference has some effects to prevent the degradation of the resins due to moisture adsorption and drying.

Specifically, the present invention provides a resin-coated carrier for an electrophotographic developer, wherein the surface of a magnetic particle is coated with a mixed resin composed of two resins, and when the two resins are denoted by the resin 1 and the resin 2, respectively, the relative difference between the respective adsorbed moisture amounts of the resin 1 and the resin 2 at a temperature of 30° C. and a relative humidity of 80% satisfies the following formula (1):

$$1 \leq |ax - b(100 - x)| \leq 10 \quad (1)$$

a: the adsorbed moisture content (% by weight) of the resin 1 b: the adsorbed moisture content (% by weight) of the resin 2 x: the content percentage of the resin 1 (0<x<100)

In the resin-coated carrier for an electrophotographic developer according to the present invention, the sum of the respective adsorbed moisture amounts of the resin 1 and the resin 2 preferably satisfies the following formula (2):

$$2 \leq ax + b(100 - x) \leq 20 \quad (2)$$

a: the adsorbed moisture content (% by weight) of the resin 1 b: the adsorbed moisture content (% by weight) of the resin 2 x: the content percentage of the resin 1 (0<x<100)

In the resin-coated carrier for an electrophotographic developer according to the present invention, the element Fe derived from the resins is contained in the mixed resin preferably in a total amount of 0.2 to 1.9% by weight.

In the resin-coated carrier for an electrophotographic developer according to the present invention, the coating of the mixed resin is performed preferably by dry coating.

The present invention also provides an electrophotographic developer including the resin-coated carrier and a toner.

By using as an electrophotographic developer a mixture prepared by mixing a toner with the resin-coated carrier for an electrophotographic developer according to the present invention, an stable image can be provided over a long term because the resin-coated carrier for an electrophotographic developer is excellent in the environment dependence of the charge amount from a low temperature and a low humidity to a high temperature and a high humidity, hardly undergoes exfoliation or abrasion of the coating resin even when being used for a long term as a developer together with a toner, and is capable of maintaining the initial environment dependence.

DETAILED DESCRIPTION OF THE PREFERRED EMBODIMENTS

Hereinafter, the embodiments for carrying out the present invention are described.

<Resin-Coated Carrier for an Electrophotographic Developer According to the Present Invention>

In the resin-coated carrier for an electrophotographic developer according to the present invention, the surface of a magnetic particle (carrier core material) is coated with a mixed resin composed of two resins by a dry method.

Examples of the magnetic particle herein used as the carrier core material include materials having hitherto been used as carriers for electrophotographic developers such as iron powder, magnetite particles, resin carrier particles and ferrite particles. Among these, the magnetic particle herein used as the carrier core material is preferably a ferrite particle including at least one selected from Mn, Mg, Li, Ca, Sr and Ti. In consideration of the recent trend of the environmental load reduction including the waste regulation, the magnetic particle herein used as the carrier core material is preferably a ferrite particle not including the heavy metals, Cu, Zn and Ni each in a content exceeding an inevitable impurity (associated impurity) range.

When the magnetic particle is a ferrite particle, a ferrite particle having a high porosity can also be used. In this case, the ferrite particle can be used as a resin-filled ferrite carrier in which the voids of the ferrite particle is filled with a resin.

The volume average particle size of the magnetic particle is preferably 15 to 80 μm, this range prevents the carrier beads carry over, and provides a satisfactory image quality. When the volume average particle size is less than 15 μm, unpreferably the carrier beads carry over comes to tend to occur. When the volume average particle size exceeds 80 μm, unpreferably the image quality comes to tend to be degraded.

(Volume Average Particle Size)

The volume average particle size was measured by a laser diffraction scattering method. As the apparatus, the Microtrac Particle Size Analyzer (model 9320-X100) manufactured by Nikkiso Co., Ltd. was used. The refractive index was set at 2.42, and the measurement was performed in an environment of a temperature of 25±5° C. and a humidity of 55±15%. The volume average particle size (median diameter) as referred to herein is the particle diameter at 50% in the cumulative distribution in the volume distribution mode in terms of the cumulative percentage of undersize particles. Water was used as the dispersion medium.

The shape factor SF-1 of the magnetic particle is preferably 102 to 130, and when the shape factor SF-1 falls within this range, the mixed resin forms a uniform coating layer, and a sufficient durability can be obtained. When the shape factor SF-1 is less than 102, the magnetic particle is close to a true sphere, and hence it comes to be difficult for the magnetic particle to impart a sufficient shear to resin particle to lead to the degradation of the uniformity of the coating layer. When the shape factor SF-1 is larger than 130, the thickness of the coating layer comes to be nonuniform and no sufficient durability is obtained.

(Shape Factor SF-1)

The shape factor SF-1 is measured as follows. Specifically, the shape factor SF-1 is a value obtained as follows: by using the JSM-6060A manufactured by JEOL Ltd., the acceleration voltage is set at 20 kV, and the SEM micrograph of the carrier was taken with a 450 magnification field of view in such a way that the particles were dispersed so as not to overlap with each other, the resulting set of image information was introduced into image analysis software (Image-Pro Plus) of Media Cybernetics Corp. to be analyzed, and thus the area and the Feret diameter (maximum) were determined and the shape factor SF-1 was derived from the following formula. The closer to a sphere the shape of the carrier is, the closer to 100 the shape factor SF-1 value is. The shape factor SF-1 was derived for each of the particles, and the average value of 100 particles was taken as the shape factor SF-1 of the carrier.

$$SF\text{-}1=[(R^2/S)\times(\pi/4)]\times 100$$

R: Feret diameter (maximum), S: Area

The two resins constituting the mixed resin with which the surface of the magnetic particle is coated is not particularly limited, and is selected from, for example, a straight silicone resin, an acrylic resin, a styrene resin, a polyester resin, an epoxy resin, a polyamide resin, a polyamideimide resin, an alkyd resin, a urethane resin and a fluororesin, and the modified resins of these resins. Two types of these resins are mixed together to prepare the mixed resin. The two types of resins preferably have a resin primary particle size of 1 μm or less because a dry method is applied. When the primary particle size is larger than 1 μm, the resin is sometimes not sufficiently sheared, or separation from the core material tends to occur, and the uniformity of the coating resin layer tends to be degraded.

In the mixed resin to be used, the adsorbed moisture content of each of the resins is preferably 0.01 to 0.5% by weight. When the adsorbed moisture content of each of the resins is less than 0.01% by weight, the charge up of the charge amount at a low temperature and a low humidity comes to be large; when the adsorbed moisture content of each of the resins exceeds 0.5% by weight, the charge amount decrease due to charge leakage at a high temperature and a high humidity comes to be large; in either of these cases, it is impossible to obtain the intended image quality.

(Adsorbed Moisture Content of Resin)

The adsorbed moisture content of each of the resins was measured with a Karl Fischer moisture meter.

As a pretreatment, each of the resins was exposed to a temperature of 30° C. and a relative humidity of 80% or less for 24 hours, and the adsorbed moisture content of each of the resins was measured with a coulometric titration method using the Karl Fischer moisture meter.

The coating amount of the mixed resin is preferably 0.1 to 3.5% by weight in relation to the carrier core material (magnetic particle). When the coating amount is less than 0.1% by weight, the toner spent is aggravated, and the temporal charge amount decrease occurs. When the coating amount exceeds 3.5% by weight, aggregation occurs between particles to aggravate the toner spent.

The method for coating the carrier core material with the mixed resin is a dry method as described above. The dry method is preferable because as compared to a wet method, the dry method is strong in the stress to the particle surface to facilitate the formation of a uniform resin coating layer free from asperities on the carrier surface, and hardly causes the aggregation between particles. In the case where the asperities of the carrier surface are larger, the stress comes to be large when the carrier is used as mixed with the toner, and hence the durability tends to be decreased. In the case where the aggregation between particles occurs to a larger extent, when the aggregation is loosened, the core material is exposed and it comes to be impossible to obtain the intended effects.

In the resin-coated carrier for an electrophotographic developer according to the present invention, when the two resins are denoted by the resin 1 and the resin 2, respectively, the relative difference between the respective adsorbed moisture amounts of the resin 1 and the resin 2 at a temperature of 30° C. and a relative humidity of 80% is required to satisfy the following formula (1). Here, the adsorbed moisture amount means a value obtained by multiplying the adsorbed moisture content by the resin content percentage (weight percentage).

$$1\leq|ax-b(100-x)|\leq 10 \quad (1)$$

a: The adsorbed moisture content of the resin 1 (% by weight)

b: The adsorbed moisture content of the resin 2 (% by weight)

x: the content percentage of the resin 1 ($0<x<100$)

When the relative difference of the adsorbed moisture amount falls within this range, the durability of the coating layer due to the mixed resin is increased, and the abrasion or exfoliation of the carrier at the time of use as the developer can be prevented. On the other hand, when the relative difference represented by the foregoing formula is larger than 10, the moisture adsorption to the resin having a larger adsorbed moisture amount surpasses the inhibition due to the resin having a smaller adsorbed moisture amount, and hence the durability is decreased. When the relative difference represented by the foregoing formula is smaller than 1, the desorption of the moisture occurs uniformly, and hence the durability tends to be decreased.

The reason for the increase of the durability of the coating layer due to the mixed resin is not clear, but is inferred as follows.

The coating layer of the carrier is known to tend to be degraded when the use of the carrier as involved in a developer in a low-temperature and low-humidity environment and in a high-temperature and high-humidity environment is repeated. Probably, this is because in a high-temperature and high-humidity environment, a superfluous fraction of moisture is incorporated into the adhesion surface between the coating layer and the core material and the fine asperities on the coating layer surface, and at a low temperature and a low humidity, such a fraction of moisture is desorbed to degrade the adhesion between the coating layer and the core material and the mutual adhesion between the resins.

Accordingly, when two resins different from each other in moisture adsorption are used, in a high-temperature and high-humidity environment, the resin having a relatively smaller adsorbed moisture content is inferred to suppress rapid moisture adsorption and the incorporation of the moisture into the adhesion surface between the coating layer and the core material and into the fine asperities on the coating layer surface. It is also inferred that in a low-temperature and low-humidity environment, a certain amount of the moisture adsorbed to the resin having a larger adsorbed moisture content suppresses the rapid charge up.

The exclusive use of a resin having a adsorbed moisture content falling within a certain range causes uniform desorption of moisture, and hence no suppression effect is obtained; the use of a resin having a small adsorbed moisture content for the purpose of suppressing the degradation of the coating layer due to the desorption of the moisture facilitates the occurrence of the charge up at a low temperature and a low humidity to degrade the environment dependence.

The conditions in the individual environments are as follows.

Normal temperature and normal pressure (N/N) environment=temperature: 20° C., relative humidity: 55%

Low-temperature and low-humidity (L/L) environment=temperature: 10° C., relative humidity: 10%

High-temperature and high-humidity (H/H) environment=temperature: 30° C., relative humidity: 80%

In the resin-coated carrier for an electrophotographic developer according to the present invention, the sum of the respective adsorbed moisture amounts of the resin 1 and the resin 2 preferably satisfies the following formula (2):

$$2\leq ax+b(100-x)\leq 20 \quad (2)$$

a: the adsorbed moisture content (% by weight) of the resin 1 b: the adsorbed moisture content (% by weight) of the resin 2 x: the content percentage of resin 1 ($0<x<100$)

When the sum represented by the foregoing formula is larger than 20, the charge leakage at a high temperature and a high humidity comes to be large. When the sum represented by the foregoing formula is smaller than 2, the charge up at a low temperature and a low humidity comes to be large.

In the resin-coated carrier for an electrophotographic developer according to the present invention, the element Fe derived from the resins is contained in mixed resin preferably in a total content of 0.2 to 1.9% by weight. The total content falling within this range allows the charge up at a low temperature and a low humidity to be reduced.

The reason for this is not clear, but is inferred as follows. Specifically, the element Fe is considered to be derived from the additives or the impurities in the resin production process, and is considered to serve as a regulator of the charge leakage. The Fe component contained in the resin is very smaller than the additive such as a conductive fine particle in the carrier preparation by the dry method, and is easily anticipated to be dispersed; and hence, this range is considered not to cause a problem of the decrease of the resin strength.

When the content of the element Fe is less than 0.2% by weight, it is impossible to sufficiently reduce the charge up; when the content of the element Fe exceeds 1.9% by weight, the charge leakage is large to cause excessive decrease of the charge amount at a high temperature and a high humidity.

(Content of Element Fe in Resin)

The content of the element Fe in the resin was measured as follows. First, the carbon component in the resin was measured with a carbon analyzer, and the components other than carbon were measured with an X-ray fluorescence element analyzer, and the content of the element Fe in the resin was derived by using the following formula:

Content of element Fe in resin(% by weight)=[(content of element Fe in components other than carbon)×(100-weight percentage of carbon component)]/100

As the carbon analysis apparatus, C-200 manufactured by LECO Japan Corp. was used, 1 g of the resin was weighed in a crucible, and the measurement was performed according to JIS Z 2611.

As the X-ray fluorescence element analyzer, ZSX100s manufactured by Rigaku Corp. was used. In a powder sample vessel for use in vacuum, about 5 g of a sample was placed, the vessel was set in a sample holder, and the measurement of the contained elements other than carbon was performed with the foregoing measurement apparatus, on the basis of the EZ scan, which is a scanning function.

<Electrophotographic Developer According to Present Invention>

The resin-coated carrier for an electrophotographic developer according to the present invention, obtained as described above, is mixed with a toner to be used as a two-component developer.

The toner used in the present invention can be produced heretofore known methods such as a suspension polymerization method, an emulsion polymerization method and a pulverizing method. An example of the production method is such that the ingredients such as a binder resin, a colorant and a charge control agent are sufficiently mixed with a mixer such as a Henschel mixer, then the mixture is melt-kneaded with an extruder such as a twin-screw extruder to be uniformly dispersed, the kneaded mixture is cooled and then finely pulverized with a pulverizer such as a jet mill, the pulverized mixture is classified and then further classified with a classifier such as an air classifier, and thus a toner having an intended particle size can be obtained. If necessary, a wax, a magnetic powder, a viscosity adjuster and other additives may also be contained in the toner. Moreover, after the classification, an external additive may also be added.

Examples of the binder resin to be used in the toner include, without being particularly limited to: polystyrene, chloropolystyrene, styrene-chlorostyrene copolymer, styrene-acrylic acid ester copolymer, styrene-methacrlyic acid copolymer, rosin-modified maleic acid resin, epoxy resin, polyester, polyetylene, polypropylene, polyurethane and silicone resin; these resins can be used, if necessary, each alone or as mixtures thereof.

Examples of the charge control agent usable in the toner include nigrosine dye, quaternary ammonium salt, organometallic complex, chelate complex, metal-containing monoazo dye.

Examples of the colorant usable in the toner include heretofore known dyes and/or pigments. Specific examples of the colorant usable in the toner include carbon black, phthalocyanine blue, permanent red, chrome yellow and phthalocyanine green.

Examples of the usable other external additive include silica, titanium oxide, barium titanate, a fluororesin fine particle and an acrylic resin fine particle; these can be used each alone or in combinations thereof.

Hereinafter, the present invention is specifically described on the basis of Examples and the like.

The types of the resins used in following Examples and Comparative Examples, the adsorbed moisture contents and the contents of the element Fe thereof are as follows.

Resin A: Acrylic resin, adsorbed moisture content: 0.11% by weight, Fe content: 0.37% by weight Resin B: Styrene acrylic resin, adsorbed moisture content: 0.03% by weight, Fe content: 2.15% by weight Resin C: Styrene acrylic resin, adsorbed moisture content: 0.02% by weight, Fe content: 0.87% by weight Resin D: Silicone resin, adsorbed moisture content: 0.29% by weight, Fe content: 1.17% by weight Resin E: Styrene acrylic resin, adsorbed moisture content: 0.06% by weight, Fe content: 0.04% by weight Resin F: Acrylic resin, adsorbed moisture content: 0.09% by weight, Fe content: 2.15% by weight Resin G: Fluororesin, adsorbed moisture content: 0.01% by weight, Fe content: 0.00% by weight Resin H: Silicone resin, adsorbed moisture content: 0.42% by weight, Fe content: 1.87% by weight

EXAMPLE 1

As the carrier core material (magnetic particle), a Mn—Mg—Sr ferrite particle having an average particle size of 40 μm and a shape factor SF-1 of 121 was used.

A resin-coated carrier was prepared by coating 100 parts by weight of the magnetic particle with 1.75 parts by weight of a mixed resin by a dry method. In the mixed resin, the resin A and the resin C were used as the resin 1 and the resin 2, respectively, and the content ratio (weight ratio) between the resin A and the resin C was 55:45.

EXAMPLE 2

A resin-coated carrier was prepared with the same magnetic particle and the same mixed resin coating amount as in Example 1 except that in the mixed resin, the resin A and the resin C were used as the resin 1 and resin 2, respectively, and the content ratio (weight ratio) between the resin A and the resin C was set at 25:75.

EXAMPLE 3

A resin-coated carrier was prepared with the same magnetic particle and the same mixed resin coating amount as in Example 1 except that in the mixed resin, the resin A and the resin C were used as the resin 1 and resin 2, respectively, and the content ratio (weight ratio) between the resin A and the resin C was set at 90:10.

EXAMPLE 4

A resin-coated carrier was prepared with the same magnetic particle and the same mixed resin coating amount as in Example 1 except that in the mixed resin, the resin G and the resin B were used as the resin 1 and resin 2, respectively, and the content ratio (weight ratio) between the resin G and the resin B was set at 20:80.

EXAMPLE 5

A resin-coated carrier was prepared with the same magnetic particle and the same mixed resin coating amount as in Example 1 except that in the mixed resin, the resin A and the resin D were used as the resin 1 and resin 2, respectively, and the content ratio (weight ratio) between the resin A and the resin D was set at 30:70.

EXAMPLE 6

A resin-coated carrier was prepared with the same magnetic particle and the same mixed resin coating amount as in Example 1 except that in the mixed resin, the resin E and the resin F were used as the resin 1 and resin 2, respectively, and the content ratio (weight ratio) between the resin E and the resin F was set at 15:85.

EXAMPLE 7

A resin-coated carrier was prepared with the same magnetic particle and the same mixed resin coating amount as in Example 1 except that in the mixed resin, the resin E and the resin F were used as the resin 1 and resin 2, respectively, and the content ratio (weight ratio) between the resin E and the resin F was set at 90:10.

COMPARATIVE EXAMPLE 1

A resin-coated carrier was prepared with the same magnetic particle and the same mixed resin coating amount as in Example 1 except that in the mixed resin, the resin A and the resin C were used as the resin 1 and resin 2, respectively, and the content ratio (weight ratio) between the resin A and the resin C was set at 20:80.

COMPARATIVE EXAMPLE 2

A resin-coated carrier was prepared with the same magnetic particle and the same mixed resin coating amount as in Example 1 except that in the mixed resin, the resin A and the resin C were used as the resin 1 and resin 2, respectively, and the content ratio (weight ratio) between the resin A and the resin C was set at 95:5.

COMPARATIVE EXAMPLE 3

A resin-coated carrier was prepared with the same magnetic particle and the same mixed resin coating amount as in Example 1 except that in the mixed resin, the resin F and the resin H were used as the resin 1 and resin 2, respectively, and the content ratio (weight ratio) between the resin F and the resin H was set at 55:45.

COMPARATIVE EXAMPLE 4

A resin-coated carrier was prepared with the same magnetic particle and the same mixed resin coating amount as in Example 1 except that in the mixed resin, the resin G and the resin C were used as the resin 1 and resin 2, respectively, and the content ratio (weight ratio) between the resin G and the resin C was set at 90:10.

Table 1 shows, for each of Examples 1 to 7 and Comparative Examples 1 to 4, the types, the adsorbed moisture contents and the contents of the element Fe of the resins 1 and 2 used, the content ratio between the resin 1 and resin 2, the relative difference of the adsorbed moisture amounts represented by the formula (1), the sum of the adsorbed moisture amounts represented by the formula (2), and the total content of Fe. Table 2 shows, for each of the resin-coated carriers in Examples 1 to 7 and Comparative Examples 1 to 4, the variation rate of the resin coating area after 50 k running, the initial L/L environment dependence, the initial H/H environment dependence, and the environment dependence of the charge amount after 50 k running.

The measurement method of the variation rate of the resin coating area, the initial environment dependences, and the variation rate of the environment dependence shown in Table 2 are as follows. The other measurement methods are as described above.

(Variation Rate of Resin Coating Area)

In the measurement of the coating area of the carrier, an electron microscope (model JSM-6100) manufactured by JEOL Ltd. was used, and the reflected electron image of the carrier is photographed at an applied voltage of 5 kV, and at a magnification of 100. The photographed image is read with a scanner, the read image is converted into an image carrying only the particles with an image analysis software "Image-Pro Plus" of Media Cybernetics Corp., the resulting particle image is binarized, the white portion (exposed core material portion) and the black portion (coated portions) are separated, and the areas of the respective portions are measured. The resin coating area (%) was calculated by using the following calculation formula.

$$\text{Resin coating area}(\%)=\{\text{black portion area}/(\text{white portion area}+\text{black portion area})\}\times 100$$

The initial resin coating area and the resin coating area after 50 k running were measured, and the variation rate of the resin coating area was derived with (resin coating area after 50 k running)/(initial resin coating area) and evaluated as follows.

(Evaluation)

A: 90% or more

B: 80% or more and less than 90%

C: less than 80%

(Environment Dependence of Initial Charge Amount)

The sample was prepared as follows. The carrier and a commercially available negatively polar toner being used in a full color printer and having an average particle size of about 6 μm were weighed so as for the toner concentration to be 7.2% by weight (weight of toner: 3.6 g, weight of carrier: 46.4 g). The weighed carrier and toner were exposed to the below-described respective environments for 12 hours or more. Subsequently, the carrier and the toner were placed in a 50-cc glass bottle, and were stirred at a number of rotations of 100 rpm for 60 minutes.

The initial charge amount and the charge amount after 50 k running were determined by measuring with a suction-type charge amount measurement apparatus (Epping q/m-meter, manufactured by PES-Laboratorium (mesh: 795 mesh, suction pressure: 105±10 mbar, suction time: 90 seconds). The conditions in the respective N/N, H/H and L/L environments are as described above. The initial L/L environment dependence and the initial H/H environment dependence are calculated with the following calculation formulas, respectively.

Initial *L/L* environment dependence(%)=[(initial *L/L* charge amount)/(initial *N/N* charge amount)]×100−100

Initial *H/H* environment dependence(%)=[(initial *H/H* charge amount)/(initial *N/N* charge amount)]×100−100

(Evaluation)

A: Initial L/L environment dependence 20%

B: 20%< initial L/L environment dependence 30%

C: Initial L/L environment dependence <30%

A: Initial H/H environment dependence ≥−20%

B: −20%> initial H/H environment dependence ≥−30%

C: −30%< initial H/H environment dependence (Variation Rate of Environment Dependence)

The variation of the environment dependence when the carrier was used for a developer for 50 k running was calculated with the following formula, and the evaluation was performed on the basis of the resulting value as follows.

Variation rate of environment dependence=(*L/L* charge amount after 50 k running−*H/H* charge amount after 50 k running)/(initial *L/L* charge amount−initial *H/H* charge amount)

(Evaluation)

A: Less than 1.2

B: 1.2 or more and less than 1.4

C: 1.4 or more

TABLE 2

| | Variation rate of resin | Environment dependence of charge amount | | |
|---|---|---|---|---|
| | coating area after 50k running | Initial L/L charge-up amount | Initial H/H charge-up amount | Variation rate after 50k running |
| Example 1 | A | A | A | A |
| Example 2 | B | A | A | B |
| Example 3 | B | A | A | B |
| Example 4 | A | B | A | A |
| Example 5 | A | B | B | A |
| Example 6 | A | B | A | A |
| Example 7 | A | B | A | A |
| Comparative Example 1 | C | B | B | C |
| Comparative Example 2 | C | B | B | C |
| Comparative Example 3 | C | B | C | C |
| Comparative Example 4 | C | C | B | C |

As shown in Table 2, the resin-coated carriers of Examples 1 to 7 were found to be satisfactory in all of the variation rate of the coating area, the initial environment dependence and the variation rate of the environment dependence after 50 k running.

On the contrary, the resin-coated carriers of Comparative Examples 1 to 4 were found to give the results such that these carriers are poor in any or all of the variation rate of the coating area, the initial environment dependence and the variation rate of the environment dependence after 50 k running.

The resin-coated carrier for an electrophotographic developer according to the present invention is excellent in the environment dependence of the charge amount from a low temperature and a low humidity to a high temperature and a high humidity, hardly undergoes the exfoliation or the abrasion of the coating resin layer and is capable of maintaining the initial environment dependence when used as a developer together with a toner; hence, the use as a developer of the resin-coated carrier for an electrophotographic developer as mixed with a toner allows stable image quality to be obtained over a long term.

TABLE 1

| | Resin 1 | | | Resin 2 | | | | | | | |
|---|---|---|---|---|---|---|---|---|---|---|---|
| | Resin | Adsorbed moisture content a (% by weight) | Fe content (% by weight) | Resin | Adsorbed moisture content b (% by weight) | Fe content (% by weight) | Resin content ratio (weight ratio) Resin 1 X | Resin content ratio (weight ratio) Resin 2 (100 − X) | Formula (1) \|ax − b(100 − x)\| | Formula (2) ax + b(100 − x) | Total content of Fe (% by weight) |
| Example 1 | A | 0.11 | 0.37 | C | 0.02 | 0.87 | 55 | 45 | 5.15 | 6.95 | 0.60 |
| Example 2 | A | 0.11 | 0.37 | C | 0.02 | 0.87 | 25 | 75 | 1.25 | 4.25 | 0.75 |
| Example 3 | A | 0.11 | 0.37 | C | 0.02 | 0.87 | 90 | 10 | 9.70 | 10.10 | 0.42 |
| Example 4 | G | 0.01 | 0.00 | B | 0.03 | 2.15 | 30 | 70 | 1.80 | 2.40 | 1.51 |
| Example 5 | A | 0.11 | 0.37 | D | 0.29 | 1.17 | 50 | 50 | 9.00 | 20.00 | 0.77 |
| Example 6 | E | 0.06 | 0.04 | F | 0.09 | 2.15 | 15 | 85 | 6.75 | 8.55 | 1.83 |
| Example 7 | E | 0.06 | 0.04 | F | 0.09 | 2.15 | 90 | 10 | 4.50 | 6.30 | 0.25 |
| Comparative Example 1 | A | 0.11 | 0.37 | C | 0.02 | 0.87 | 20 | 80 | 0.60 | 3.80 | 0.77 |
| Comparative Example 2 | A | 0.11 | 0.37 | C | 0.02 | 0.87 | 95 | 5 | 10.35 | 10.55 | 0.40 |
| Comparative Example 3 | F | 0.09 | 2.15 | H | 0.42 | 1.87 | 55 | 45 | 13.95 | 23.85 | 2.02 |
| Comparative Example 4 | G | 0.01 | 0.00 | C | 0.02 | 0.87 | 90 | 10 | 13.95 | 1.10 | 0.09 |

Consequently, the present invention is capable of being used widely particularly in the fields of full color machines required to provide high image quality and high-speed machines required to have reliability in image maintenance and durability.

What is claimed is:

1. A resin-coated carrier for an electrophotographic developer, wherein the surface of a magnetic particle is coated with a mixed resin composed of two resins, and when the two resins are denoted by the resin 1 and the resin 2, respectively, the relative difference between the respective adsorbed moisture amounts of the resin 1 and the resin 2 at a temperature of 30° C. and a relative humidity of 80% satisfies the following formula (1):

$$1 \leq |ax - b(100 - x)| \leq 10 \quad (1)$$

a: the adsorbed moisture content (% by weight) of the resin 1 b: the adsorbed moisture content (% by weight) of the resin 2 x: the content percentage of the resin 1 ($0<x<100$).

2. The resin-coated carrier for an electrophotographic developer according to claim 1, wherein the sum of the respective adsorbed moisture amounts of the resin 1 and the resin 2 satisfies the following formula (2):

$$2 \leq ax + b(100 - x) \leq 20 \quad (2)$$

a: the adsorbed moisture content (% by weight) of the resin 1 b: the adsorbed moisture content (% by weight) of the resin 2 x: the content percentage of the resin 1 ($0<x<100$).

3. An electrophotographic developer comprising the resin-coated carrier according to claim 2 and a toner.

4. The resin-coated carrier for an electrophotographic developer according to claim 1, wherein the element Fe derived from the resins is contained in the mixed resin in a total amount of 0.2 to 1.9% by weight.

5. An electrophotographic developer comprising the resin-coated carrier according to claim 4 and a toner.

6. The resin-coated carrier for an electrophotographic developer according to claim 1, wherein the coating of the mixed resin is performed by dry coating.

7. An electrophotographic developer comprising the resin-coated carrier according to claim 6 and a toner.

8. An electrophotographic developer comprising the resin-coated carrier according to claim 1 and a toner.

9. The resin-coated carrier for an electrophotographic developer according to claim 1, wherein the two resins are selected from a straight silicone resin, an acrylic resin, a styrene resin, a polyester resin, an epoxy resin, a polyamide resin, a polyamideimide resin, an alkyd resin and a fluororesin.

* * * * *